United States Patent [19]

Griffin

[11] Patent Number: 5,006,009

[45] Date of Patent: Apr. 9, 1991

[54] OUTDOOR POST ASSEMBLY

[76] Inventor: Richard D. Griffin, 107 Maplebrook, Laurens, S.C. 29360

[21] Appl. No.: 516,033

[22] Filed: Apr. 27, 1990

[51] Int. Cl.[5] ..... E01F 9/01

[52] U.S. Cl. ..... 404/11; 40/608

[58] Field of Search ..... 404/10, 11; 40/608, 40/612

[56] References Cited

U.S. PATENT DOCUMENTS

| | | | |
|---|---|---|---|
| 1,402,465 | 1/1922 | Wood | 40/608 |
| 1,866,982 | 7/1932 | Michener | 40/608 |
| 2,083,826 | 6/1937 | Burress | 404/11 |

FOREIGN PATENT DOCUMENTS

| | | | |
|---|---|---|---|
| 2725399 | 12/1978 | Fed. Rep. of Germany | 404/10 |
| 8800888 | 11/1988 | Netherlands | 404/10 |

*Primary Examiner*—William P. Neuder

*Attorney, Agent, or Firm*—Bailey & Hardaway

[57] ABSTRACT

An outdoor post assembly has a support member A positionable in the ground for carrying a post member B in upright position thereon in spring biased relation by a coiled spring D connected to one of the members at spaced locations adjacent a juncture therebetween, whereby the post may be maintained in horizontal alignment and returned to upright position automatically after being knocked over as by a grass cutting device.

9 Claims, 2 Drawing Sheets

OUTDOOR POST ASSEMBLY

BACKGROUND OF THE INVENTION

This invention relates to the provision of a highway post which will permit cutting of grass bordering on highways without lifting or otherwise avoiding highway posts and markers during highway maintenance or replacement of posts because of damage received from being struck by traffic vehicles.

Spring biased highway posts have been proposed wherein springs are carried above the ground as illustrated in U.S. Pat. Nos. 2,103,410; 2,121,379; 2,141,067; 2,949,324; 3,193,230; and 4,238,096. The use of coiled springs which are partially above and partially below the ground and which flex intermediate their ends are illustrated in U.S. Pat. Nos. 1,013,410 and 1,284,376. Highway posts of the type described above are usually provided for the purpose of yielding when being inadvertently struck by traffic.

Accordingly, it is an important object of this invention to provide a spring loaded highway post which is calculated to be routinely struck and overturned as by highway maintenance vehicles, especially grass cutters and the like.

Another object of the invention is to provide a spring biased post capable of righting itself automatically and of self-alignment after being knocked over for any reason.

Another object of the invention is to provide a spring biased highway post wherein a coiled tension spring is located on one side or the other of a base member forming a juncture between a support member and a post member.

Another object of the invention is to provide a spring biased post wherein a coiled tension spring is carried in a ground support and connected adjacent ground level to a post member.

SUMMARY OF THE INVENTION

A highway sign post is illustrated which has a spring biased upper post member carried by a support member positionable in the ground for righting itself automatically. A coiled tension member exerts a force between the two members at a juncture or junction between them which is preferably at about ground level. Preferably, the coiled tension spring is carried in the support member in the ground and has connection at an upper end at spaced locations upon a base carried by the post member at the juncture so as to be self-aligning.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

A spring biased outdoor post assembly for carrying a highway reflector, sign and the like includes a support member A positioned within the ground. A post member B is carried in upright position upon the support member extending above the ground. A base C is carried at a lower end of the post member mounting the post member upon said support member forming a juncture therebetween. A coiled tension spring D is connected on one end to one of the members at laterally spaced locations E adjacent the juncture. The coiled tension spring is connected on the other end to the other of the members remote from the spaced locations to exert a resilient force between the support member and the post member at the juncture. Thus, the coiled tension spring exerts at the spaced locations a torsional force for maintaining the post in proper horizontal alignment and for returning the post to upright position after being displaced laterally as by a highway maintenance device. Preferably, the spring is carried in the support member in the ground. Preferably, the spaced locations are carried upon a lower surface of the base member.

Figure 1:
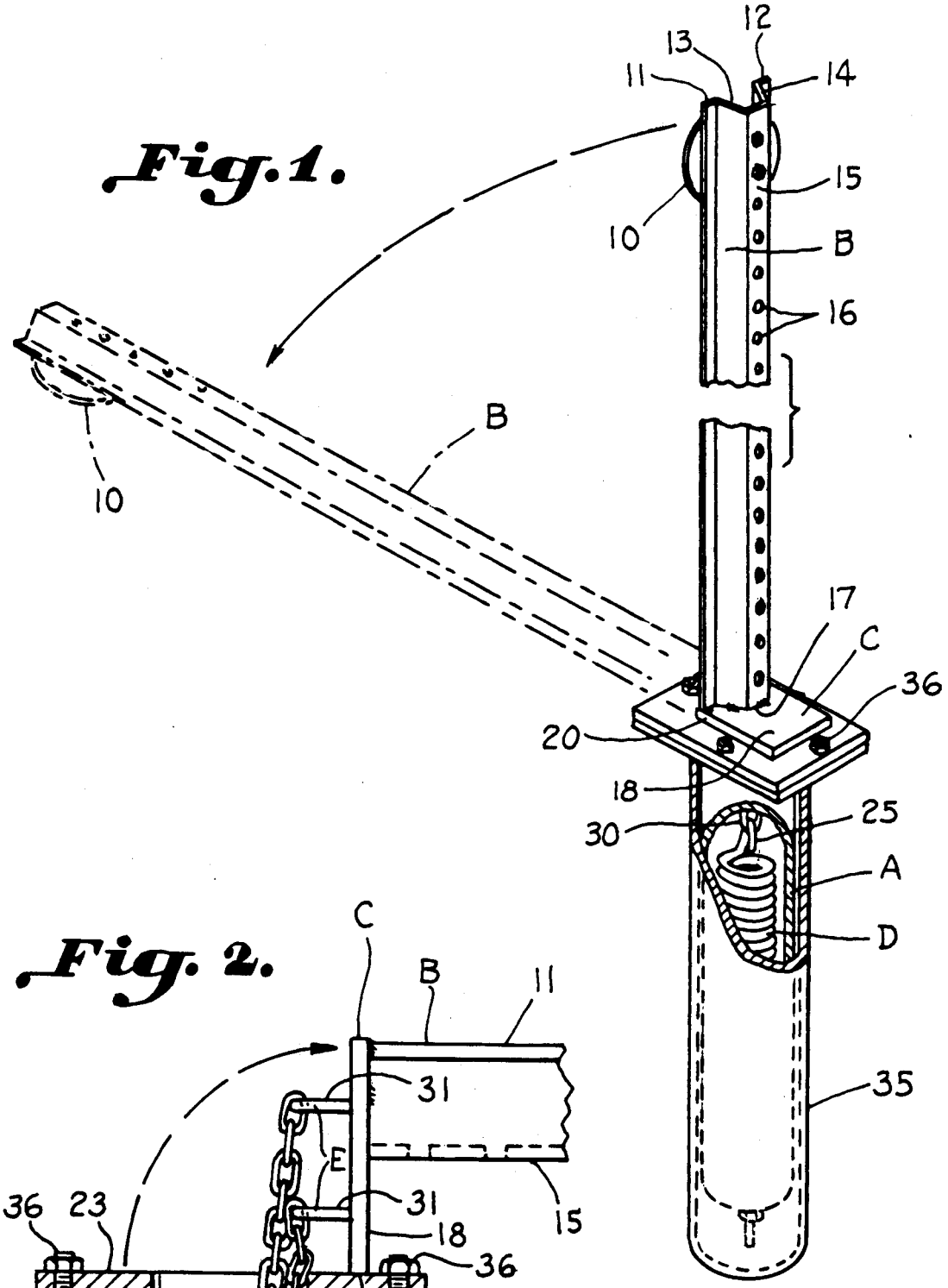
FIG. 1 is a perspective view illustrating a spring biased outdoor post constructed in accordance with the invention as a highway reflector carrying post in upright and overturned position.

FIG. 1 illustrates a spring biased outdoor post assembly constructed in accordance with the present invention for carrying a highway reflector 10. The post B includes opposed flanges 11 and 12 bridged by web members 13 and 14 bridged in turn by the base member 15 which carries the usual spaced openings 16 therein. While the invention is illustrated in the context of a highway sign used for supporting a reflector, such may be used in connection with any other type of post wherein self-righting and self-aligning features are important. The post in FIG. 1 is illustrated in broken lines as having been dislodged and in a generally horizontal position.

The post B is illustrated as having a base C secured at a lower end as by welding at 17. The base C is generally rectangular and has an aligning member 18 projecting outwardly of the base opposite the flanges 11 and 12. The base C includes a portion 19 which is secured directly beneath the post member B. The base C has opposed straight ends 18*a* and 19*a*, together with flat straight sides 20, to assist in maintaining the post in alignment so that the reflector faces in the proper direction regardless of the direction from which a blow may be received by the post member.

Figure 2:
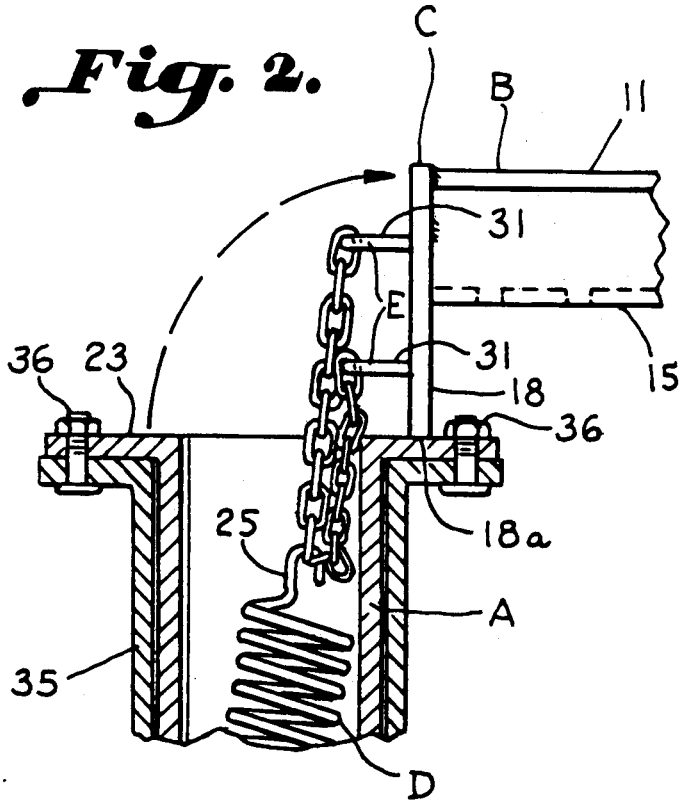
FIG. 2 is an enlarged sectional side elevational view illustrating the connection of a coiled spring to a base carrying an upper post member at spaced locations with the post member in overturned position.
Figure 3:
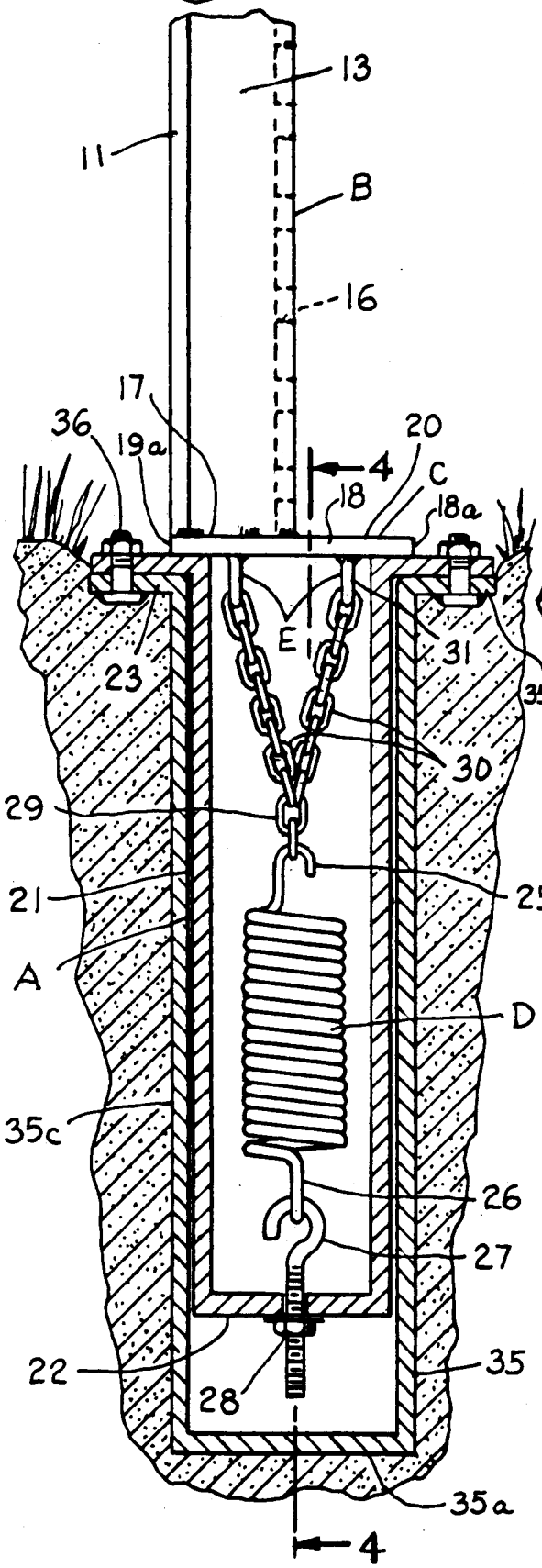
FIG. 3 is a sectional elevation illustrating a support member in the ground carrying a coiled spring and connections therefor.
Figure 4:
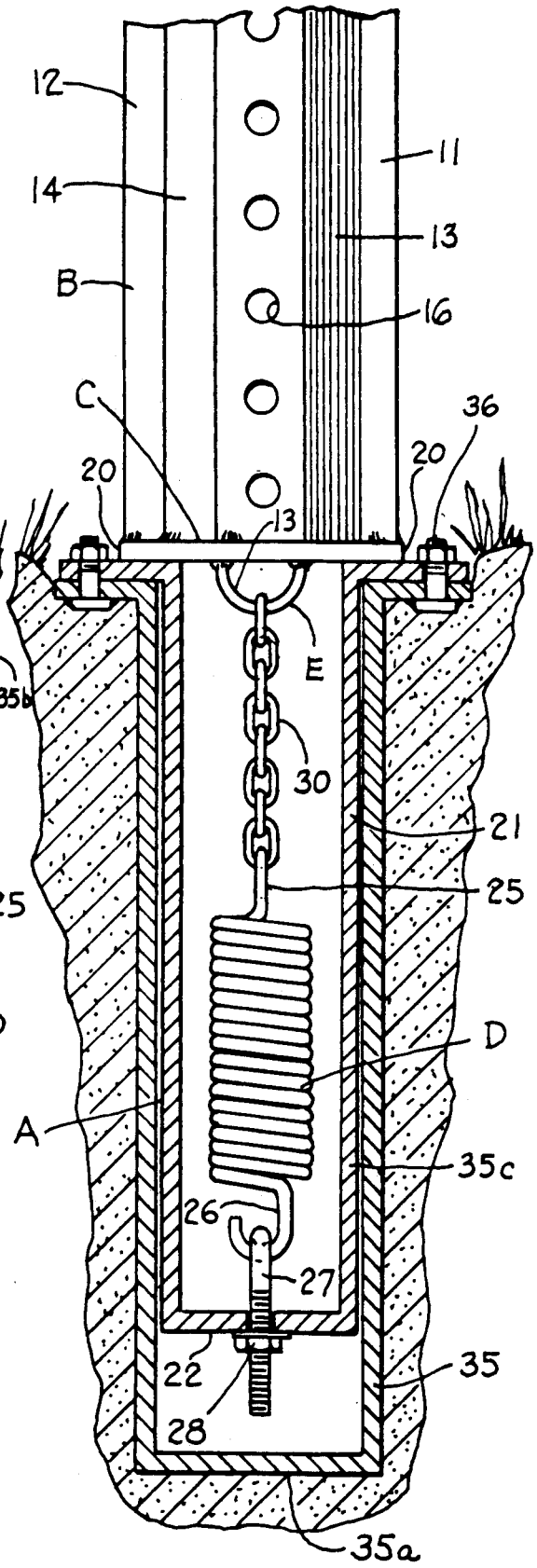
FIG. 4 is a sectional elevation taken on the line 4—4 in FIG. 3.

The support member A is illustrated as being carried within the ground or earth as illustrated in FIGS. 3 and 4. The support member A has a tubular member 21 which is closed at one end as at 22 by an end closure, while at the opposite end a platform 23 is formed by an outwardly extending flange defining an open end. The platform defined by the flange 23 serves as a support for the base C. As shown in FIG. 2, the post member is maintained in proper aligned relation although knocked over as by receiving a force from a grass cutting or mowing machine. This alignment is maintained by the aligning member 18 and the surface 18a thereof which is maintained in alignment upon the platform 23.

A coiled spring D is contained within the support member and has hooked ends 25 and 26. The lower hooked end 26 has connection with a suitable threaded fastener 27 which is secured as by the nut 28 within the end closure member 22 at the lower end of the support member A. The upper end of the spring 25 is connected to spaced connecting members E carried by a lower side of the base C as by link 29 and lengths of chain 30. The spaced locations E have connection with the lengths of chain 30. The spaced locations are illustrated as being spaced U-bolts 31 having a threaded connection at each end with the base.

The drawings further illustrate the use of a compartment 35 which may remain buried in the earth or ground as illustrated in FIGS. 3 and 4 for carrying and protecting the components outlined above. The compartment 35 includes lower end closure member 35*a* and a flange 35*b* at an open upper end extending outwardly from a cylindrical intermediate portion 35*c*. The flange 35*b* at the upper end is connected by suitable threaded fasteners 36 including nuts and bolts to the platform 23.

It is thus seen that a self-righting and self-aligning spring biased outdoor post has been provided which will improve the maintenance operation for highways, since they are designed to be knocked down in the regular course of maintenance operation. Posts constructed in accordance with the present invention serve the further purpose of being self-righting and self-aligning as when struck by traffic and when receiving a blow from any direction. The cost of highway maintenance may be significantly reduced in terms of supplies, labor and equipment. The cost of replacing damaged post may be alleviated because the posts of the present invention are calculated to receive blows, which may damage the present posts, without receiving any damage and in the regular course of their usefulness.

While a preferred embodiment of the invention has been described using specific terms, such description is for illustrative purposes only, and it is to be understood that changes and variations may be made without departing from the spirit or scope of the following claims.

What is claimed is:

1. A spring biased outdoor post assembly for carrying a highway reflector, sign or the like comprising:

a support member positioned within the ground;

a post member carried in upright position upon said support member extending substantially above the ground;

a base carried at a lower end of said post member mounting said post member upon said support member forming a juncture therebetween;

a single coiled tension spring connected on one end to one of said members at laterally spaced locations adjacent said juncture; and said coiled tension spring being connected on the other end to the other of said members remote from said spaced locations to exert a resilient force between said support member and said post member at said juncture;

whereby said single coiled tension spring exerts at said spaced locations a torsional force for maintaining said post in proper horizontal alignment and for returning said post to upright position after being displaced laterally as by a highway maintenance device.

2. The structure set forth in claim 1 wherein said spring is carried in said support member.

3. The structure set forth in claim 2 wherein said spaced locations are carried upon a lower surface of said base member.

4. The structure set forth in claim 1 wherein said support member has an outwardly extending platform for carrying said base and contains said coiled spring connected at a lower end thereof.

5. The structure set forth in claim 4 including a compartment containing said support member, said compartment having a flange carried at an upper open end thereof fastened to said platform.

6. The structure set forth in claim 4 wherein said post member has opposed flanges and wherein an aligning member projects outwardly of said base opposite said flanges.

7. A spring biased outdoor post assembly for carrying a highway reflector, sign or the like comprising:

a support member positionable within the ground;

a post member positionable to be carried in upright position upon said support member extending above the ground;

a base carried at a lower end of said post member mounting said post member upon said support member forming a juncture therebetween, said base having an outwardly projecting aligning member;

a single coiled tension spring connected on one end to a lower surface of said base at laterally spaced locations adjacent said juncture; and said single coiled tension spring being positionable to be carried in said support member and connected on the other end to said support member remote from said one end to exert a resilient force between said support member and said post member at said juncture;

whereby said coiled tension spring exerts at said spaced locations a torsional force for returning said post to upright position after being displaced laterally as by a highway maintenance device.

8. The structure set forth in claim 7, wherein said support member has an outwardly extending platform for carrying said base.

9. The structure set forth in claim 7 including a compartment containing said support member, said compartment having a flange carried at an upper open end thereof fastened to said platform.

* * * * *